United States Patent [19]

Porowski et al.

[11] 4,434,840

[45] Mar. 6, 1984

[54] EXPANSION JOINT FOR REACTOR OR HEAT EXCHANGER

[75] Inventors: Janek S. Porowski, Pittsburgh; William J. O'Donnell, Bethel Park; Ray G. Fasiczka, Mckeesport, all of Pa.

[73] Assignee: O'Donnell & Associates Inc., Pittsburgh, Pa.

[21] Appl. No.: 286,687

[22] Filed: Jul. 24, 1981

[51] Int. Cl.[3] ..... F28F 7/00

[52] U.S. Cl. ..... 165/82; 165/158

[58] Field of Search ..... 165/82, 83, 158, 164; 29/157.4; 122/512

[56] References Cited

U.S. PATENT DOCUMENTS

| | | | |
|---|---|---|---|
| 1,809,915 | 6/1931 | Smith | 165/83 |
| 3,812,907 | 5/1974 | Linning | 165/158 |
| 4,215,745 | 8/1980 | Tuckmantel | 165/164 |

*Primary Examiner*—William R. Cline
*Assistant Examiner*—John F. McNally
*Attorney, Agent, or Firm*—William J. Ruano

[57] ABSTRACT

An expansion joint for heat exchangers, reactors, steam boilers and the like to compensate for differential displacements. Differential axis expansion occurs when the pressure within the tubes or outside the tubes is raised or when a thermal expansion of the tubes and shells are different. The invention comprises a multi-layer flexible connection between the tube sheet to shell junction. The thin layers can bend parallel and accommodate large axial displacements between the shell and tubes without excessive stresses in the tube sheets. The fully penetrated but-weld of a central layer can be easily inspected by X-ray and provide the required seal between the shell and tube sheets. Other layers increase the strength of the joint.

2 Claims, 1 Drawing Figure

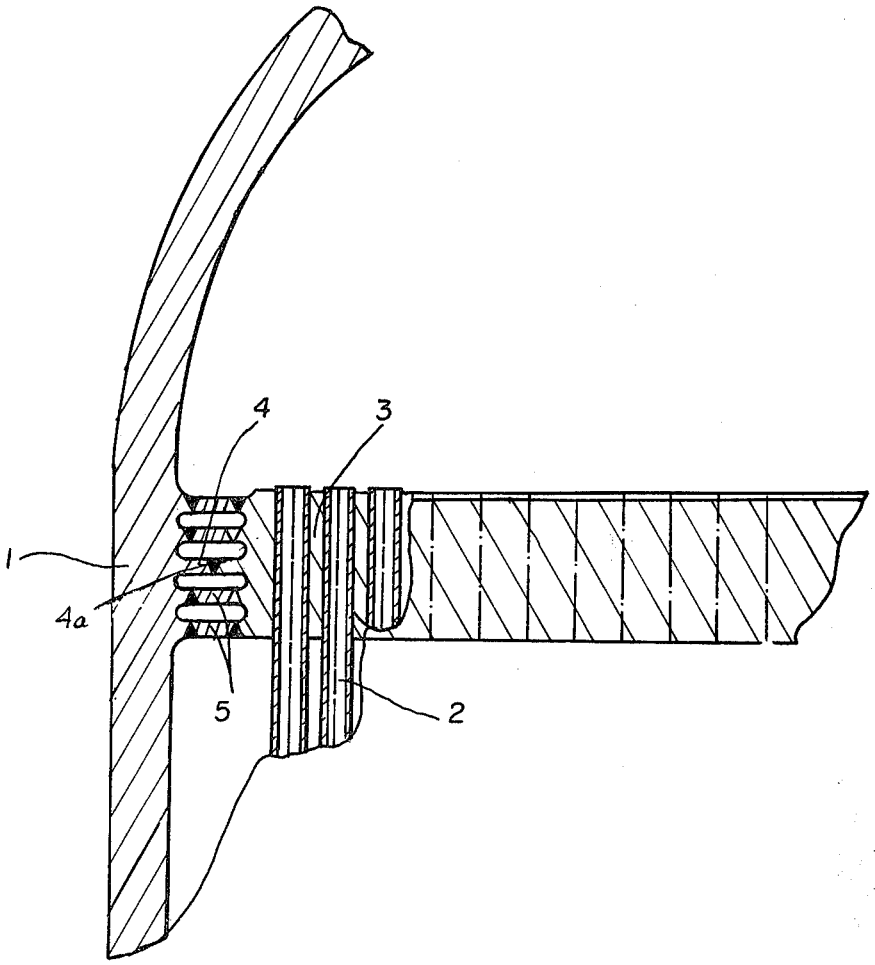
4
3
1
4a
5
2

EXPANSION JOINT FOR REACTOR OR HEAT EXCHANGER

This invention relates to an expansion joint to compensate for differential displacements in heat exchangers, reactors, steam boilers and the like.

An outstanding disadvantage of ths usual joint which is a solid one between the shell and tube sheet is that this joint is subjected to shear and bending stresses corresponding to the deflections needed to make deformations of the joints compatible.

Differential axial expansion occurs when the pressure within the tubes or outside the tubes is raised, or when the thermal expansion of the tubes and shell are different.

The tubesheet to shell junction is often designed as a fixed connection where the solid rim is attached to the shell, thereby preventing free differential movement. Other solutions including a floating head are also used where the tubesheet can move with respect to the shell. For the fixed tubesheet design of large diameters and high pressures, excessive stresses occur in the ligaments connecting the unperforated and perforated regions of the tubesheet. A floating head design for such conditions results in high cost and often is technically not feasible.

An object of the present invention is to provide a novel joint between the tube sheet and shell to overcome the above named disadvantages.

A more specific object of the invention is to provide a novel multi-ply expansion joint between the tube sheet and shell to compensate for differential displacements in the above-mentioned apparatus.

Other objects and advantages will become more apparent from the following description taken with the accompanying drawing wherein:

The FIGURE is a vertical, cross-section of view of a fragmentary portion of a multi-ply expansion joint in a reactor or heat exchanger and embodying the principles of the present invention.

Referring more particularly to the FIGURE of the drawing, numeral 1 denotes the shell of a heat exchanger, reactor, steam boiler or similar device having integrally secured a tube sheet 3 supporting a plurality of parallel tubes 2. The normal solid rim of tube sheet 3 is, according to the present invention, replaced by a multi-layer flexible connection comprising a plurality of thin metallic layers 5. The thin layers 5 can all bend substantially parallel and therefore accommodate large axial displacements between the shell 1 and tubes 2 without excessive stresses in the tubesheets 3.

The fully penetrating but-weld 4*a* of the central layer 4 provides the required seal between the shell and tubesheet.

Moreover, it can be inspected by X-ray and other methods. The other layers 5 may be welded at the end portions and are provided in order to increase the strength of the joint, to protect the crevices and to provide a redundant, highly reliable expansion joint which will not leak. Since these layers serve only to back up the central layer 4, full penetration of the welds is not required. The layers 5 may be of the same metal as the shell 1 or tube sheet 3 or of a different metal.

Thus it will be seen that we have provided an efficient and highly effective multi-ply joint between the shell and tube sheet of a reactor, heat exchanger or similar device, so as to compensate for differential displacements or differential axial expansion when pressure within the tubes or outside the tubes is raised or when thermal expansion of the tubes and shells are different.

While we have illustrated and described a single specific embodiment of our invention, it will be understood that this is by way of illustration only and that various changes and modifications may be contemplated in our invention which are within the scope of the following claims.

We claim:

1. Apparatus for use as a heat exchanger, reactor, or steam boiler, comprising a substantially cylindrical metallic shell, a metallic tube sheet inside of and at right angles to said shell and supporting the end portion of a plurality of tubes extending in parallel with the axis of said shell, and a multi-ply expansion joint of thin straight metallic layers extending entirely within said shell and in the plane of said tube sheet at right angles to said shell in closely spaced parallel relationship and connecting the perimeter of said tube sheet to said shell by welds, whereby the layers of said joint may bend only substantially parallel to accommodate only axial displacements between the shell and tubes without excessive stresses in the tube sheet.

2. Apparatus as recited in claim 1 wherein a central ply of said joint has a central butt-weld forming a seal between said shell and tube sheet.

* * * * *